US011306922B2

(12) United States Patent
Lee et al.

(10) Patent No.: US 11,306,922 B2
(45) Date of Patent: Apr. 19, 2022

(54) LOCAL EXHAUST DEVICE

(71) Applicant: LG Electronics Inc., Seoul (KR)

(72) Inventors: Sangcheol Lee, Seoul (KR); Wontae Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 17/040,443

(22) PCT Filed: Mar. 8, 2019

(86) PCT No.: PCT/KR2019/002723
§ 371 (c)(1),
(2) Date: Sep. 22, 2020

(87) PCT Pub. No.: WO2019/190075
PCT Pub. Date: Oct. 3, 2019

(65) Prior Publication Data

US 2021/0025598 A1 Jan. 28, 2021

(30) Foreign Application Priority Data

Mar. 27, 2018 (KR) ..... 10-2018-0035483

(51) Int. Cl.
*F24C 15/20* (2006.01)

(52) U.S. Cl.
CPC ..... *F24C 15/2042* (2013.01); *F24F 2221/46* (2013.01)

(58) Field of Classification Search
CPC .. F24C 15/2042; F24C 15/2071; F24C 15/20; F24F 2221/46
See application file for complete search history.

(56) References Cited

U.S. PATENT DOCUMENTS 3,943,836 A * 3/1976 Kuechler ..... F24C 15/20 126/299 D
6,044,838 A * 4/2000 Deng ..... F24C 15/2028 126/299 D (Continued)

FOREIGN PATENT DOCUMENTS

KR 1020060018147 2/2006
KR 1020120093583 8/2012

(Continued)

OTHER PUBLICATIONS

PCT International Search Report in International Application No. PCT/KR2019/002723, dated Jun. 17, 2019, 30 pages (with English translation).

(Continued)

*Primary Examiner* — Jorge A Pereiro
*Assistant Examiner* — Nikhil P Mashruwala
(74) *Attorney, Agent, or Firm* — Fish & Richardson P.C.

(57) ABSTRACT

A local exhaust device includes a main body part having an inlet port formed on a lower surface thereof and a vertex forming device installed on the main body part for forming a vortex so as to induce intake of external air through the inlet port. The vortex forming device comprises a swirler disposed on the inlet port and rotated so as to form a vortex; a driving part for rotating the swirler, and a flow guide disposed on the inlet port for guiding downstream the flowing air in a rotating process of the swirler. The flow guide comprises an upper surface disposed on an upper portion of the swirler, wherein the upper surface of the flow guide comprises an open region for opening the upper portion of the swirler and a closed region for blocking the upper portion of the swirler.

10 Claims, 10 Drawing Sheets

(56) References Cited

U.S. PATENT DOCUMENTS

| | | | | |
|---|---|---|---|---|
| 10,082,305 | B2 * | 9/2018 | Oh | F04D 25/166 |
| 10,156,385 | B1 * | 12/2018 | Kapsha | F25B 41/40 |
| 10,295,195 | B2 * | 5/2019 | Kim | F24C 15/2028 |
| 10,782,030 | B2 * | 9/2020 | Gargiulo | F24C 15/2071 |
| 10,890,335 | B2 * | 1/2021 | Kim | F24C 15/2092 |
| 2006/0278216 | A1 * | 12/2006 | Gagas | F24C 15/2028 126/299 D |
| 2013/0206230 | A1 | 8/2013 | Sridharan et al. | |
| 2016/0150601 | A1 | 5/2016 | Kim et al. | |
| 2016/0177972 | A1 * | 6/2016 | Santucci | F04D 29/624 417/423.14 |
| 2016/0273779 | A1 | 9/2016 | Kim et al. | |

FOREIGN PATENT DOCUMENTS

| | | |
|---|---|---|
| KR | 101761053 | 7/2017 |
| KR | 1020180006641 | 1/2018 |
| KR | 1020180011585 | 2/2018 |
| WO | WO2012102462 | 8/2012 |
| WO | WO2018012745 | 1/2018 |

OTHER PUBLICATIONS

Extended European Search Report in European Appln. No. 19777699.0, dated Nov. 29, 2021, 9 pages.

* cited by examiner

LOCAL EXHAUST DEVICE

CROSS-REFERENCE TO RELATED APPLICATIONS

This application is a National Stage application under 35 U.S.C. § 371 of International Application No. PCT/KR2019/002723, filed on Mar. 8, 2019, which claims the benefit of Korean Patent Application No. 10-2018-0035483, filed on Mar. 27, 2018. The disclosures of the prior applications are incorporated by reference in their entirety.

TECHNICAL FIELD

The present invention relates to a local exhaust device, and more particularly, to a local exhaust device used for suctioning contaminants floating indoors and discharging the sucked contaminants to the outside.

BACKGROUND

In general, a kitchen is provided with a countertop in which a heating device such as an electric heater or a gas range is arranged for cooking such as boiling or baking by applying high temperature heat to food.

Here, a cooked object heated by high heat of a heating device located on the countertop causes contaminants such as smoke, odor, and oil vapor during a heating process. These contaminants may float by heat and spread throughout the kitchen or a room, and the spread contaminants may provide an unpleasant odor to cause disgust. In particular, in a closed kitchen, these contaminants may be factors which reduce concentration of a worker and ruin the worker's health.

Therefore, a range hood is installed in the kitchen to discharge contaminants such as smoke, odor, and oil vapor that occurs when food is cooked to the outside.

Such a range hood may include a hood body forming an outer appearance of the range hood and having an inlet port installed on a lower surface thereof, a blower generating an air flow for suctioning air into the hood body and discharging air to outside of a room, a filter installed in the hood body and filtering air sucked into the body, and a pipe forming a passage for discharging air sucked into the body through the filter to outside of the room.

The range hood configured as described above operates as follows.

Contaminants that occur while heating a cooked object by a heating device at the countertop rise by its own buoyancy due to a higher temperature than the surrounding air or are forcibly raised by an air flow formed by the blower of the range hood, and the raised contaminants are discharged through the pipe connected to an external duct through the filter.

The range hood, however, may suction air and contaminants near the inlet port formed on the lower surface of the hood body to some extent but cannot properly suction air and contaminants located away from the inlet port.

This is because a flow speed of the sucked air flow decreases in inverse proportion to the square of a distance to the inlet port in a direction away from the inlet port, and therefore, collection efficiency for the contaminants does not increase proportionally even if a flow speed of suction of a suction fan increases.

In other words, suction performance of the range hood of the related art decreases drastically in a direction away from the inlet port and an effective intaking area is limited to an area as small as a diameter of the inlet port, and as such, the range hood of the related art is not suitable for removing contaminants that occurs away from the inlet port.

In order to supplement these shortcomings, a range hood using a vortex has been developed. This range hood blows air in an amount similar to an intake flow rate into a space to generate the vortex and increase collection efficiency using the generated concentrated vortex.

However, according to this range hood, noise occurs due to turbulence that occurs due to mutual interference between a flow blown out and a flow sucked in a narrow area under the inlet port, contaminants in the space may be additionally spread due to the flow blown in the air, and additional installation such as a blower, a filter, a pipe, and the like is required to generate the vortex.

Meanwhile, recently, an exhaust device using a swirler has been introduced. The swirler is rotatably installed adjacent to an inlet port of the exhaust device and includes a rotating plate in the form of a disk, a plurality of blades arranged and installed on a lower surface of the rotating plate to form a vortex, and a driving motor that rotates the rotating plate.

The swirler configured as described above generates a vortex around the inlet port of the exhaust device during rotation, thereby expanding a suction area of the exhaust device.

As the size of the vortex generated by such a swirler increases, the suction area of the exhaust device may be expanded. In particular, if the vortex may be formed at a front side of the exhaust device, air and contaminants located away from the exhaust device may be sucked more effectively.

SUMMARY

An aspect of the present invention is to provide a local exhaust device having an improved structure to provide improved suction performance.

To solve the technical problem as described above, there is provided a local exhaust device including a main body part having an inlet port formed on a lower surface thereof; and a vertex forming device installed on the main body part and configured to form a vortex so as to induce intake of external air through the inlet port.

The vortex forming device may include a swirler disposed at the inlet port and rotated to form the vortex; a driving part configured to rotate the swirler; and a flow guide disposed at the inlet port and configured to guide air flowing by a rotation of the swirler downward.

The flow guide may include an upper surface disposed at an upper portion of the swirler, wherein the upper surface of the flow guide comprises an open region configured to open the upper portion of the swirler and a closed region configured to block the upper portion of the swirler.

The open region may be formed by penetrating a portion of the upper surface of the flow guide so that a passage along which external air is sucked into the main body part through the inlet port is opened, and the closed region may be formed as a horizontal plane blocking the passage along which external air is sucked into the main body part through the inlet port.

The closed region may be located in front of the open region.

The closed region may be disposed above a rotation region of the swirler and disposed at a position being biased forward at the rotation region of the swirler.

The upper surface of the flow guide may be halved to the open region located at a rear thereof and the closed region located at a front thereof.

The main body part may include: a first casing accommodating an intake device configured to generate an intake force for intaking air; and a second casing provided below the first casing and having a horizontal sectional area larger than that of the first casing, the second casing having the inlet port provided on a lower surface thereof.

The first casing may extend upward from an upper surface of the second casing, a rear surface of the first casing and a rear surface of the second casing may be coplanar, the rear surface of the first casing and the rear surface of the second casing may face a wall, and a front surface of the second casing may be located in front of a front surface of the first casing.

A rotation center of the swirler is located frontward with respect to a vertical line passing through a rotation center of the intake device.

The closed region may be formed as a horizontal plane blocking the passage along which external air is sucked into the main body part through the inlet port and may be located in front of the open region.

The closed region may be formed as a horizontal plane blocking the passage along which external air is sucked into the main body part through the inlet port, and the closed region may be disposed above a rotation region of the swirler and may be disposed at a forwardly inclined position at the rotation region of the swirler.

The closed region may be formed as a horizontal plane blocking the passage along which external air is sucked into the main body part through the inlet port, the closed region may be disposed above a rotation region of the swirler and may be located in front of a front surface of the first casing, and at least a portion of the open region may be disposed at the rear with respect to the front surface of the first casing.

The flow guide may further include a guide surface extending to be inclined outward and downward from an outer edge of the upper surface of the flow guide.

According to the local exhaust device of the present invention, since the closed region for increasing the intensity of a downward air flow induced by the rotation of the swirler is located at the front adjacent to the front surface of the second casing, the vortex formed by the vertex forming device is formed larger in front of the local exhaust device, whereby the suction performance for contaminated air located at the front side of the local exhaust device may be effectively improved, thereby providing further improved suction performance.

DETAILED DESCRIPTION

Figure 1:
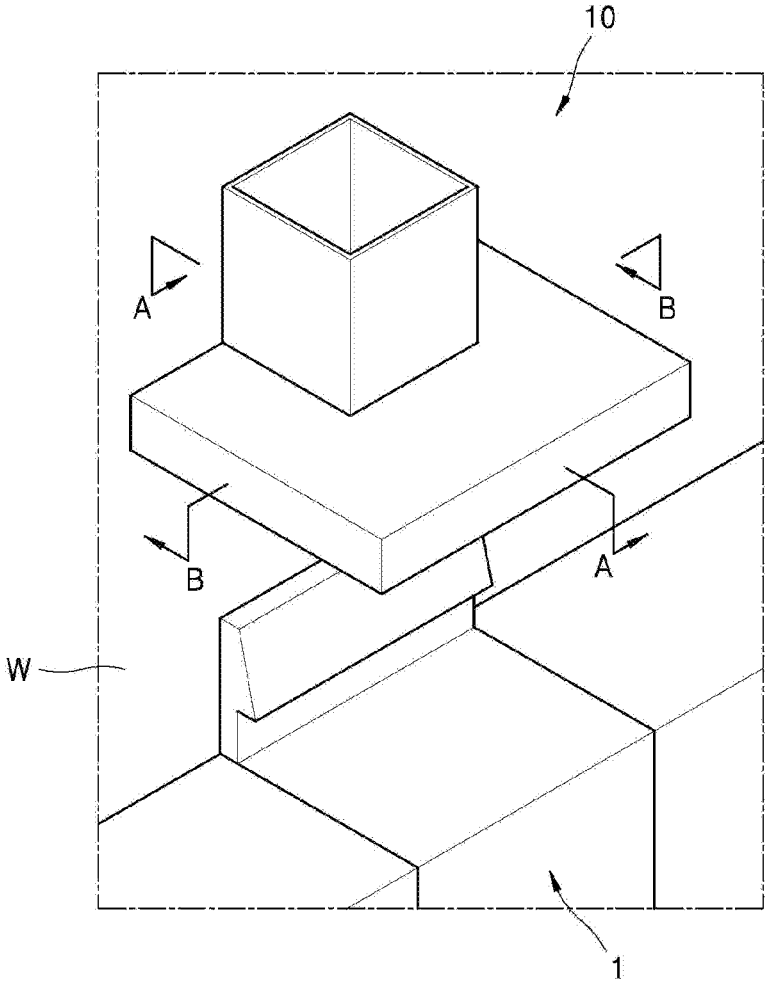
FIG. 1 is a view showing a state in which a local exhaust device according to an embodiment of the present invention is installed in a kitchen.

Hereinafter, an embodiment of a local exhaust device according to the present invention will be described with reference to the accompanying drawings. For convenience of description, thicknesses of lines or sizes of components shown in the drawings may be exaggerated for clarity and convenience of description. The terms used henceforth are defined in consideration of the functions of the present disclosure and may be altered according to the intent of a user or operator, or conventional practice. Therefore, the terms should be defined on the basis of the entire content of this disclosure.

[Overall Structure of Local Exhaust Device]

FIG. 1 is a view showing a state in which a local exhaust device according to an embodiment of the present invention is installed in a kitchen.

Referring to FIG. 1, the local exhaust device 10 according to an embodiment of the present invention may be installed in a space requiring smooth exhaust of contaminated air. As an example, FIG. 1 shows the local exhaust device 10 installed in a kitchen.

In the kitchen, a cooking appliance 1 for cooking food may be provided, and air around the cooking appliance 1 may be contaminated while food is cooked by the cooking appliance 1. The contaminated air rises above the cooking appliance 1 because a temperature thereof is higher than that of other surrounding air.

When the contaminated air rises and is stalled in the kitchen where the cooking appliance 1 is placed, comfort of the kitchen is deteriorated and smell contained in the contaminated air soaks into the kitchen, causing a problem that requires a long period of ventilation.

The local exhaust device 10 is installed above the cooking appliance 1 to allow contaminated air generated in the process of cooking food by the cooking appliance 1 to be discharged to the outside of the kitchen.

In most cases, the cooking appliance 1 is located adjacent to a wall of the kitchen. In order to effectively exhaust contaminated air caused in the process of cooking food by the cooking appliance 1 installed as described above, the local exhaust device 10 may be installed on the wall W of the kitchen or adjacent to the wall W of the kitchen.

Depending on a structure of the kitchen, a storage cabinet may exist on one side or both sides of the local exhaust device 10. Hereinafter, the wall W of the kitchen or a wall of the storage cabinet will be collectively referred to as "wall".

Figure 2:
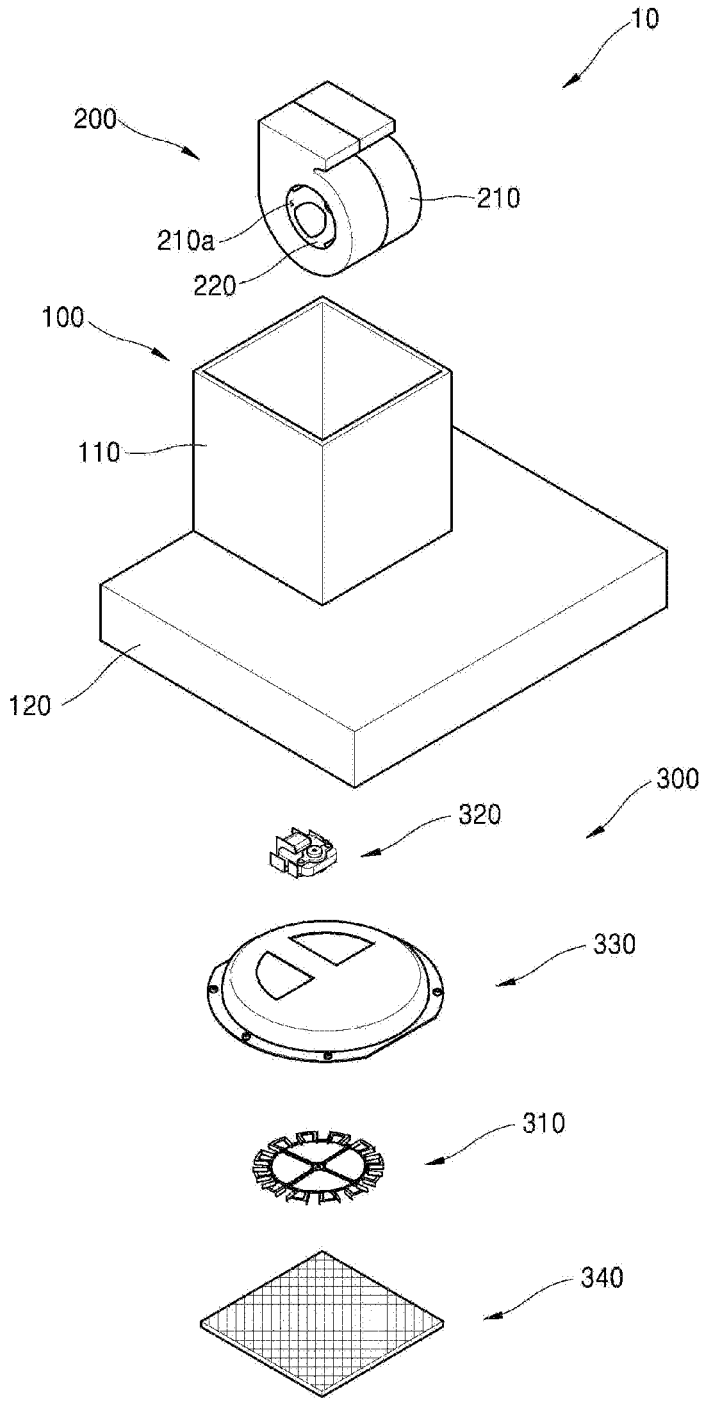
FIG. 2 is an exploded perspective view showing a disassembled state of the local exhaust device shown in FIG. 1.
Figure 3:
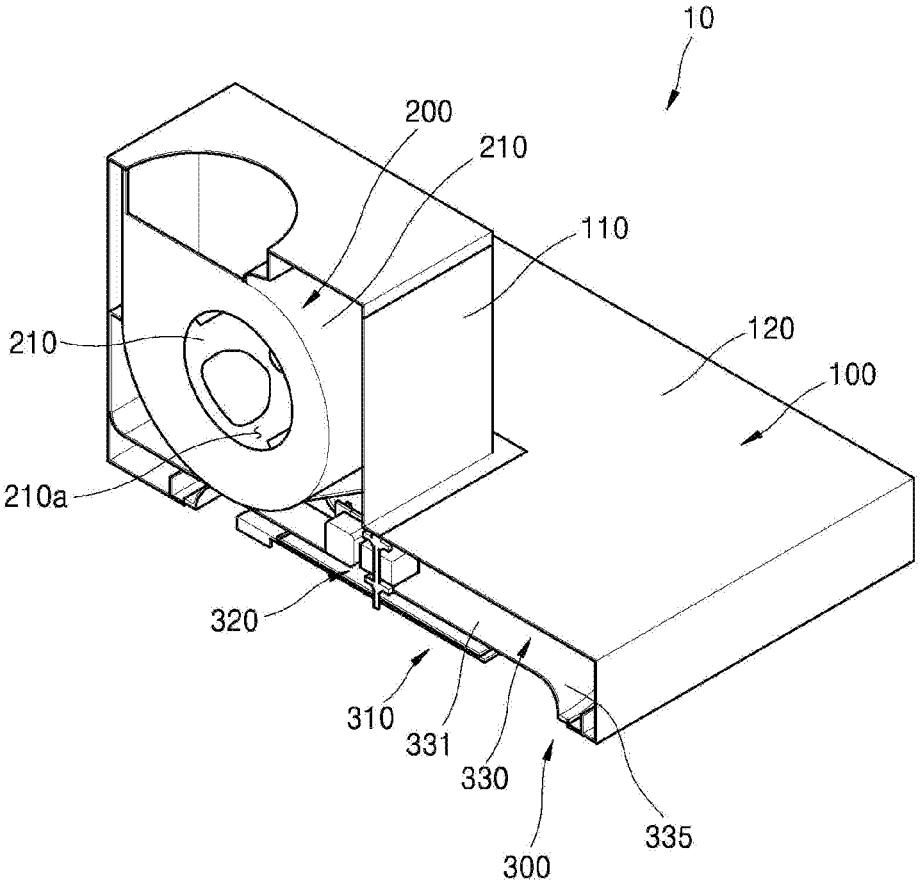
FIG. 3 is a cross-sectional view taken along line "A-A" of FIG. 1.
Figure 4:
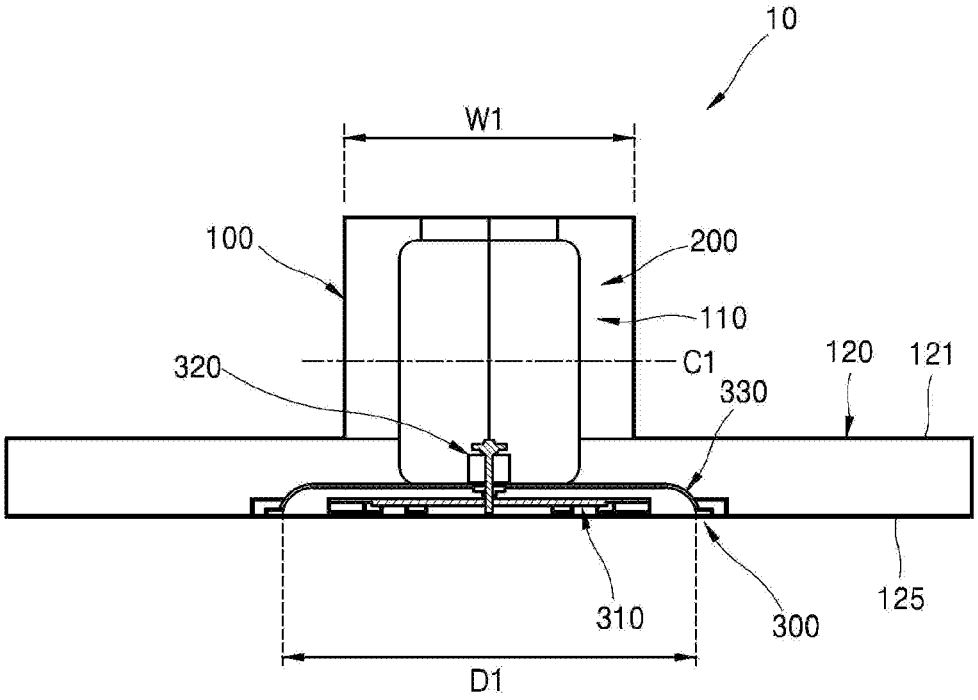
FIG. 4 is a cross-sectional view taken along line "B-B" of FIG. 1.
Figure 5:
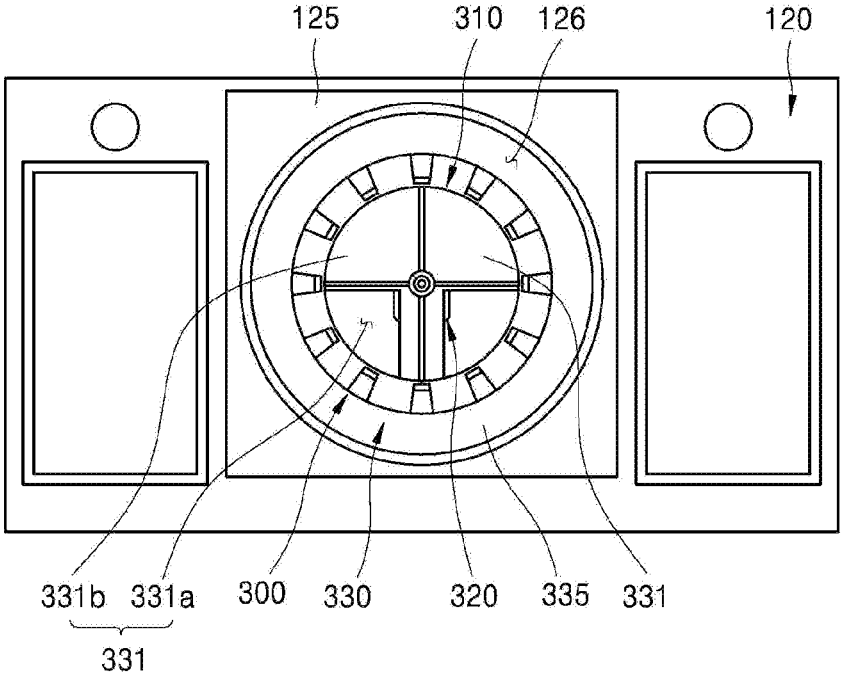
FIG. 5 is a bottom view showing a bottom surface of the local exhaust device shown in FIG. 1.
Figure 6:
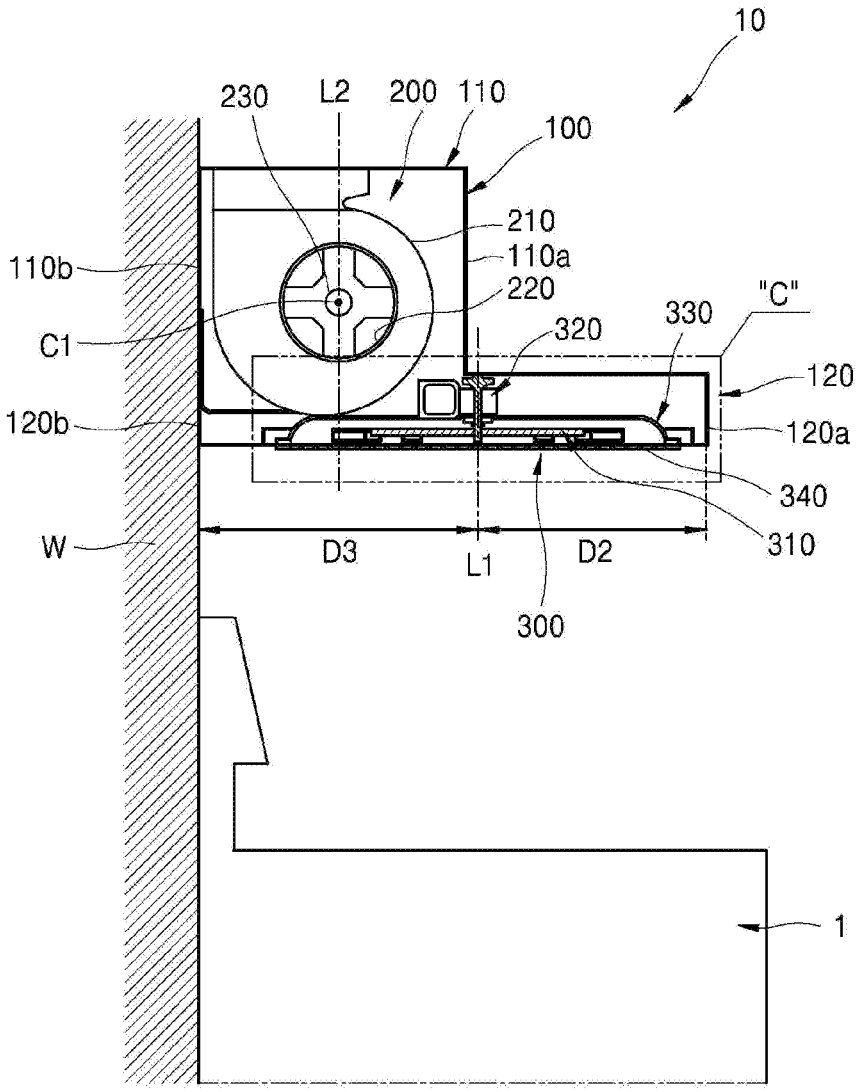
FIG. 6 is a view showing an arrangement structure of an intake device and a vortex forming device according to an embodiment of the present invention.

FIG. 2 is an exploded perspective view showing a disassembled state of the local exhaust device shown in FIG. 1, FIG. 3 is a cross-sectional view taken along line "A-A" of FIG. 1, and FIG. 4 is a cross-sectional view taken along line "B-B" of FIG. 1. FIG. 5 is a bottom view showing a bottom surface of the local exhaust device shown in FIG. 1, and FIG. 6 is a view showing an arrangement structure of an intake device and a vortex forming device according to an embodiment of the present invention.

Referring to FIGS. 2 to 6, the local exhaust device 10 according to an embodiment of the present invention includes a main body part 100 and a blowing device 200.

The main body part 100 forms the exterior of the local exhaust device 10 according to the present embodiment and may include a first casing 110 and a second casing 120.

The first casing 110 is located at an upper portion of the main body part 100, and an accommodating space is formed inside the first casing 110. In this embodiment, the first casing 110 is illustrated to have a box shape with an open lower part. The open lower part of the first casing 110 is connected to an open upper part of the second casing 120, whereby air sucked through the second casing 120 may flow to an accommodating space inside the first casing 110.

The blowing device 200 is installed in the accommodating space inside the first casing 110. The blowing device 200 is installed in the first casing 110, i.e., in the accommodating space inside the main body part 100 to form an air flow that suctions external air into the main body part 100 through an inlet port 126.

The second casing 120 is located at a lower portion of the main body part 100, and a space part allowing air sucked through the inlet port 126 to flow is formed in the second casing 120. In this embodiment, the second casing 120 is illustrated to have a flat box shape in which a length in a front-rear direction and a width in a left-right direction are longer than a height thereof.

The inlet port 126 is formed on a lower surface of the second casing 120 formed as described above. The inlet port 126 is formed to penetrate the lower surface of the second casing 120 to form a passage through which external air is sucked into the space part inside the second casing 120.

The inlet port 126 is located at the center of the second casing 120 in a width direction, so that a passage for suctioning external air into the space part inside the second casing 120 is provided at the center of the second casing 120 in the width direction.

According to the present embodiment, the second casing 120 may be provided in a form in which a suction duct 121 and a lower panel 125 are coupled in the up-down direction.

The suction duct 121 is provided in the form of a flat box with an open lower surface. The lower panel 125 is coupled to the open lower surface of the suction duct 121, and the space part is formed inside the suction duct. The space part is formed such that upper and lateral portions thereof are surrounded by the suction duct 121 and a lower portion thereof is surrounded by the lower panel 125. The first casing 110 is connected to an upper portion of the suction duct 121, and a connection portion of the suction duct 121 with the first casing 110 is opened so that the inside of the second casing 120 and the inside of the first casing 110 are connected to each other.

The lower panel 125 is coupled to the open lower portion of the suction duct 121 to form a bottom surface of the second casing 120. The inlet port 126 may be formed such that the center of the lower panel 125 in the width direction is penetrated.

According to this embodiment, a horizontal cross-sectional area of the second casing 120 is larger than that of the first casing 110.

As an example, a length of the second casing 120 in the front-rear direction may be longer than a length of the first casing 110 in the front-rear direction (see FIG. 3).

In addition, a width of the second casing 120 in the left-right direction may be longer than a width W1 of the first casing 110 in the left-right direction (see FIG. 4).

In addition, a front surface 110*a* of the second casing 120 is located in front of a front surface 120*a* of the first casing 110, and a rear surface 110*b* of the second casing 120 and a rear surface of the first casing 110 are coplanar.

In this embodiment, the rear surfaces 110*b* and 120*b* of each casing 110 and 120 are defined as being a surface facing the wall W, and the front surfaces 110*a* and 120*a* of each casing 110 and 120 are opposite surfaces of the rear surfaces.

Also, in this embodiment, a front side is defined as a direction in which the wall W faces a user when the user stands facing the wall W. That is, when the user stands facing the wall W, the front surface 110*a* of the second casing 120 is positioned closer to the user than the front surface 120*a* of the first casing 110. This means that the front surface 120*a* of the second casing 120 is located farther from the wall W than the front surface 110*a* of the first casing 110 based on the wall W.

In addition, the local exhaust device 10 of the present embodiment may further include a vortex forming device 300. The vortex forming device 300 is installed inside the main body part 100, more specifically, in the second casing 120, to form a vortex around the inlet port 125 so that external air is sucked into the main body part 100 through the inlet port 126.

[Structure of Blowing Device]

The blowing device 200 may include a scroll housing 210, an impeller 220, and a first driving unit 230.

The scroll housing 210 forms the exterior of the blowing device 200, and a suction hole 210*a* is formed to form a passage through which external air is sucked into the impeller 220. Both sides of the scroll housing 210 are opened, and the blowing device 200 serves as a suction passage for suctioning air through the both sides of the scroll housing 210.

In this embodiment, the scroll housing 210 is illustrated to have a shape including a lying cylindrical shape n which the both sides are open, and the open both sides of the scroll housing 210 are provided as a suction hole 210*a* of the scroll housing 210.

An accommodating space for accommodating an impeller 220 is formed inside the scroll housing 210. In addition, an inner circumferential surface of the scroll housing 210 facing the accommodating space is formed as a curved surface surrounding an outer circumferential surface of the impeller 220.

A discharge part is provided on the scroll housing 210. A discharge port connected to the accommodating space inside the scroll housing 210 is formed to be penetrated, and the discharge port forms a passage through which air sucked into the accommodating space in which the impeller 220 is accommodated is discharged to the outside of the blowing device 200.

The discharge part may protrude to the outside of the main body part 100 through the first casing 110 in an upward direction and may be connected to an external duct (not shown) outside the main body part 100. Accordingly, air sucked into the accommodating space in which the impeller 220 is accommodated may be discharged to the outside through the discharge port formed at the discharge part and the external duct connected thereto.

The impeller 220 is provided to be rotated about a shaft extending in a lateral direction. A space through which air sucked through the side of the impeller 220 is introduced is formed inside the impeller 220.

The impeller 220 may be provided in a form including a turbo fan or a sirocco fan. When the impeller 220 is provided in a form including a turbo fan, the impeller 220 may be configured in a form including backward curved blades of the turbo fan. When the impeller 220 is provided in a form including a sirocco fan, the impeller 220 may be configured in a form including the multi-blade blades of the sirocco fan.

The first driving unit 230 is provided to provide power for rotating the impeller 220. The first driving unit 230 may be provided in the form of a motor including a rotor which is a rotating part of the motor, a stator which is a stationary part of the motor, a motor case that forms the exterior of the motor and accommodates the rotor and stator therein, and a shaft rotated together with the rotor to rotate the impeller 220.

Such a first driving unit 230 may be provided in a form in which the motor is installed outside the scroll housing 210 and the impeller 220, or may be provided in a form in which the motor is inserted into the space part inside the impeller 220.

The blowing device 200 including the configuration described above may be installed in a form in which a part thereof is accommodated in the first casing 110 and the other part thereof is accommodated in the second casing 120. In this embodiment, it is illustrated that most of the region of the blowing device 200 is accommodated in the first casing 110 and the remaining partial region corresponding to a lower portion of the blowing device 200 is accommodated in the second casing 120.

Here, the blowing device 200 may be accommodated in the first casing 110 in a state in which a rotation center C1 of the impeller 220 is horizontal.

And, in a state in which at least a portion of the blowing device 200 is accommodated in the first casing 110, both sides of the scroll housing 210 of the blowing device 200 may be spaced apart from horizontal both sides of the first casing 110.

Accordingly, contaminated air introduced into the main body part 100 may be introduced into both sides of the scroll housing 210 through a space between the first casing 110 and the scroll housing 210, and air introduced into the scroll housing 210 through both sides of the scroll housing 210 may be discharged to an upper side of the blowing device 200 through a discharge part 215.

The blowing device 200 may be operated in one of a plurality of modes classified according to the amount of air sucked by the blowing device 200.

For example, the blowing device 200 may be operated in a high air volume mode to form an air flow in which external air is sucked into the main body part 100 through the inlet port 126 with a high air volume or may be operated in a low air volume mode in which an intake air flow at a relatively weak flow rate is formed compared to the high air volume mode.

Here, whether the blowing device 200 is operated in the high air volume mode or the low air volume mode may be determined by a rotation speed of the first driving unit 230 that rotates the impeller 220. That is, as the first driving unit 230 is operated to rotate the impeller 220 at a high speed, the blowing device 200 may be operated in the high air volume mode, and as the first driving unit 230 is operated to rotate the impeller 220 at a relatively low speed, the blowing device 200 may be operated in the low air volume mode.

When the blowing device 200 is operated in the high air volume mode, it is possible to form an intake air flow with a high flow rate, so that contaminants from a farther distance may be sucked, and thus collection efficiency for the contaminants may be increased.

When the blowing device 200 is operated in the low air volume mode, the speed of the intake air flow is lowered compared to the high air volume mode, so that the collection efficiency of the local exhaust device 10 for contaminants may be lowered but noise that occur due to driving of the blowing device 200 and power consumption thereof may be reduced.

According to the present embodiment, when the blowing device 200 is operated in the low air volume mode, the operation of the vortex forming device 300 may be performed together. The vortex forming device 300 may be provided in the main body part 100 to form a vortex to induce suction of external air through the inlet port 126.

Such a vortex forming device 300 generates a vortex in a shape such as a donut around the inlet port 126 to enlarge a suction region of the local exhaust device 10, whereby the contaminants and air may be sucked more efficiently even if the speed of the intake air flow is low.

[Structure of Vortex Forming Device]

Figure 7:
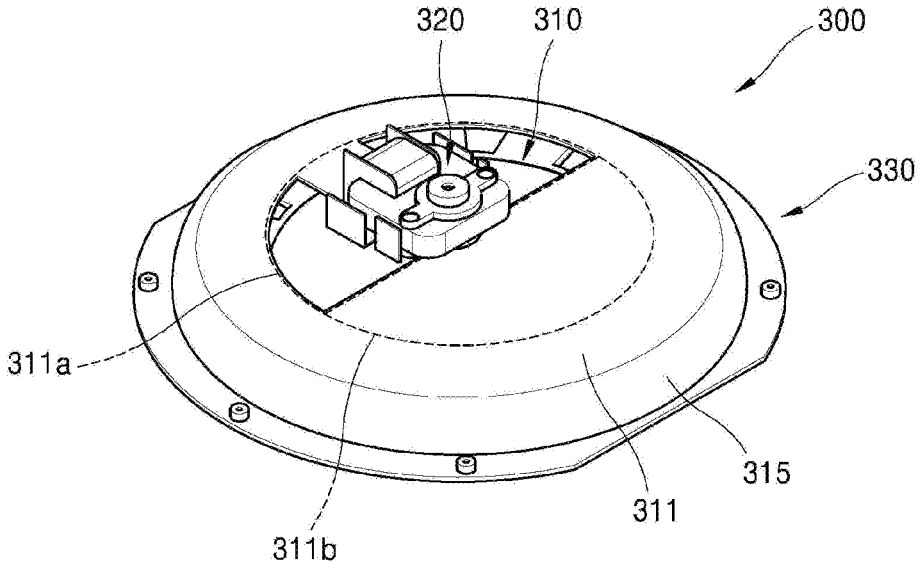
FIG. 7 is a perspective view showing the vortex forming device shown in FIG. 6 separated.
Figure 8:
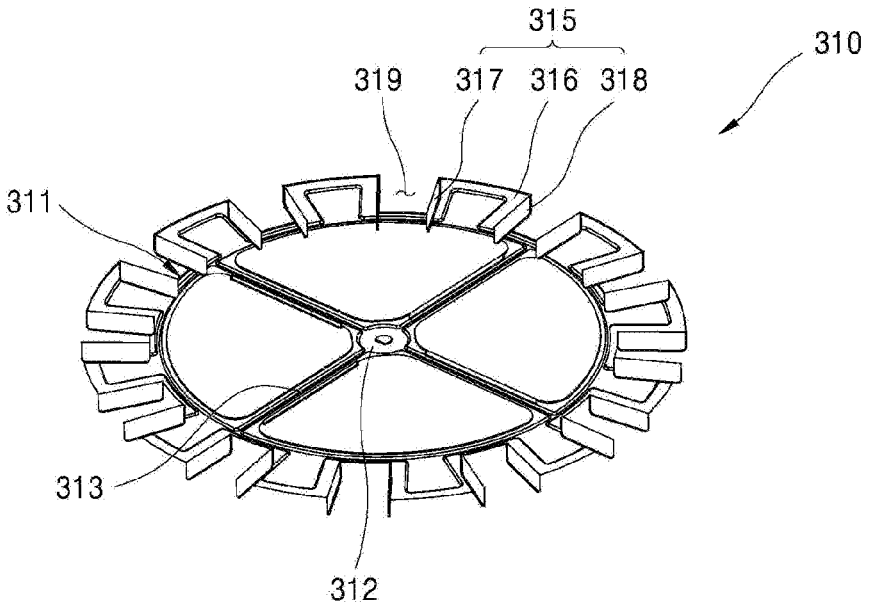
FIG. 8 is a perspective view showing a separated swirler shown in FIG. 7 separated.

FIG. 7 is a perspective view showing the separated vortex forming device shown in FIG. 6, and FIG. 8 is a perspective view showing a separated swirler shown in FIG. 7.

Referring to FIGS. 6 to 8, the vortex forming device 300 includes a swirler 310, a second driving unit 320, and a flow guide 330.

The swirler 310 is located in the inlet port 126 and may be rotated to form a vortex around the inlet port 126. This swirler 310 may include a rotating plate 311 and a blade part 315.

The rotating plate 311 is located to be positioned below the inlet port 126, and is installed to be located in a region surrounded by a recess of the lower panel 125. A center part of the rotating plate 311 is connected to a shaft of the second driving unit 320 and the rotating plate 311 is provided to rotate around this shaft, i.e., a rotating shaft extending in the up-down direction.

A coupling part 312 for coupling the rotating plate 311 to the shaft of the second driving part 320 is provided at the center of the rotating plate 311, and a through hole allowing air sucked toward the inlet port 126 to pass therethrough is provided in the rotating plate 311.

In this embodiment, the rotating plate 311 is illustrated to have a circular ring shape. According to this, the through hole of the rotating plate 311 is formed to penetrate between an outer circumferential surface of the rotating plate 311 and the coupling part 312. The coupling part 312 is provided at the center of the rotating plate 311 at a position surrounded by the through hole and may be fixed to the rotating plate 311 by a connecting part 313 traversing between the outer circumferential surface of the rotating plate 311 and the coupling part 312. As an example, the rotating plate 311 may be formed in a form in which the an outer circumferential surface of the rotating plate 311, the coupling part 312 and the connecting part 313 are connected in a shape of "⊗".

The blade part 315 is located to surround the outer side of the rotating plate 311 in a diameter direction. The blade part 315 may include a planar portion 316 and blades 317 and 318.

The planar portion 316 is coplanar with the rotating plate 311. A plurality of such planar portions 316 are located along a rotation direction of the rotating plate 311 to surround the outer side of the rotating plate 311 in the diameter direction.

In addition, a through hole part 319 is formed between the two planar portions 316 adjacent to each other. Since the through hole part 319 is formed to penetrate between the planar portion 316 and the planar portion 316, thereby forming a passage penetrating the blade part 315 along an extending direction, i.e., in an up-down direction, of the rotating shaft that rotates the rotating plate 311. That is, the planar portion 316 and the through hole part 319 are alternately located along the rotation direction of the rotating plate 311 on the outer side of the rotating plate 311 in a diameter direction.

The blades 317 and 318 are formed to protrude from the planar portion 316 in the extending direction of the rotating shaft, i.e., in the lower direction. These blades 317 and 318, while rotating together with the rotating plate 311, serve to push air outward of the rotating plate 311, and the vortex forming device 300 may generate a vortex around the inlet port 126 by the action of the blades 317 and 318.

A plurality of the blades 317 and 318 are located along the rotational direction of the rotating plate 311 so as to surround an outer side of the rotating plate 311 in the diameter direction. That is, the blades 317 and 318 are located on each of the planar portions 316. In addition, each of the blades 317 and 318 may be formed by bending a portion of the planar portion 316 in a downward direction.

According to the present embodiment, the blades 317 and 318 may include a first blade 317 and a second blade 318.

The first blade 317 is located on one side of the planar portion 316 according to the rotational direction of the rotating plate 311, and the second blade 318 is located on the other side of the planar portion 316 according to rotational direction of the rotating plate 311.

That is, one side of the planar portion 316 is bent to form the first blade 317, and the other side of the planar portion 316 is bent to form the second blade 318.

Alternatively, each of the plurality of blades 317 and 318 may be coupled to the rotating plate 311.

The vortex forming device 300 including the swirler 310 as described above is installed on the inlet port 126 through which air is sucked. Therefore, a flow of air sucked through the inlet port 126 may affect the operation of the vortex forming device 300, and the vortex forming device 300 may affect the flow of air sucked through the inlet port 126.

For example, in the process of performing the operation of the vortex forming device 300, if a frequency of the air sucked toward the inlet port 126 collides with the swirler 310 is high, a rotational speed of the swirler 310 may be lowered due to resistance formed in this case so that a vortex may not be properly formed and suction of air through the inlet port 126 may be hindered.

In consideration of this, the vortex forming device 300 of the present embodiment includes the passage hole part 319 forming a passage penetrating the swirler 310. According to this, a portion of air introduced to the swirler 310 is pushed outward of the swirler 310 by the action of the blades 317 and 318 to form a vortex, and the rest of the air passes through the swirler 310 through the through hole part 319. It passes through the swirler 310 and flows out to an upper portion of the vortex forming device 300.

Accordingly, the resistance formed due to a collision between the air sucked toward the inlet port 126 and the swirler 310 may be reduced, and thus, the performance of the vortex forming device 300 may be further improved and air may be more smoothly sucked through the inlet port 126.

Meanwhile, the second driving unit 320 is provided to provide power to rotate the swirler 310 and is installed inside the main body part 100, specifically, inside the second casing 120. The second driving unit 320 is located at the top of the configuration of the vortex forming device 300 and may include a motor in which a shaft that transmits rotational force extends downward.

The swirler 310 rotated by the second driving unit 320 is located in front of the intake device 200. That is, a first extension line L1 extending coaxially with a rotation center of the swirler 310 is located in front of a second extension line L2 extending coaxially with the rotation center of the intake device 200 (See FIG. 6).

In addition, the first extension line L1 may be an extension line extending coaxially with the shaft of the second driving unit 320, and the first extension line L1 may be located in front of the scroll housing 210.

As an example, the first extension line L1, which is an extension line extending coaxially with the shaft of the second driving unit 320, may be located in front of the front surface 110*a* of the first casing 110.

As another example, the first extension line L1, which is an extension line extending coaxially with the shaft of the second driving unit 320, may be located between the impeller 220 and the front surface 110*a* of the first casing 110.

A distance D2 from the first extension line L1 to the front surface 120*a* of the second casing 120 is shorter than a distance from the first extension line L1 to the rear surface 120*b* of the second casing 120.

According to this arrangement, a portion of the inlet port 126 formed on the lower surface of the second casing 120 overlaps the scroll housing 220 in the up-down direction, and another part of the inlet port 126 does not overlap the scroll housing 220 in the up-down direction.

The flow guide 330 is located at the inlet port 126 and is provided in a form that surrounds the swirler 310 at an upper outside to serve to guide air flowing downward during the rotation of the swirler 310.

In addition, the local exhaust device 10 of the present embodiment may further include a suction grille 340 for filtering air sucked through the inlet port 126.

In this embodiment, the suction grille 340 is illustrated to have a square plate-shaped grille, but the shape of the suction grille 340 is not limited thereto. The shape of the suction grille 340 may be formed in a circular plate shape corresponding to the shape of the inlet port 126 and may be determined in various other shapes as necessary.

The suction grille 340 may be coupled to the lower panel 125 of the second casing 120 so as to installed at a lower portion of the vortex forming device 300. As an example, the suction grille 340 may be coupled to the second casing 120 in a sliding coupling manner.

The suction grille 340 installed as described above provides a function of filtering air sucked through the inlet port 126, as well as a function of enhancing safety for devices and users by blocking an external object, e.g., the user's hand or cooking utensils, from accessing the swirler 310.

[Structure of Flow Guide]

Figure 9:
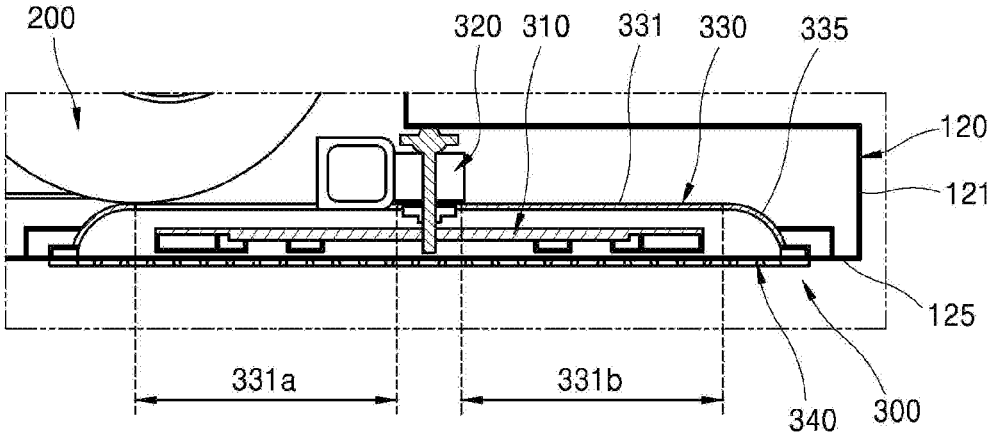
FIG. 9 is an enlarged view of a portion "C" of FIG. 6.

FIG. 9 is an enlarged view of a portion "C" of FIG. 6.

Referring to FIGS. 6, 8, and 9, the flow guide 330 may include an upper surface 331 and a guide surface 335.

The upper surface 331 is a portion that forms an upper surface of the flow guide 330 and is located above the swirler 310. In this embodiment, it is illustrated that the upper surface 331 is formed in a disk shape having a slightly larger diameter than the swirler 310.

The guide surface 335 is provided in a shape surrounding the outside of the swirler 310 at the side of the swirler 310. The guide surface 335 is formed in a shape that extends obliquely downward from an outer edge of the upper surface 331 formed in a disk shape.

That is, the flow guide 330 is provided such that the upper surface 331 located at an upper portion of the swirler 310 and the guide surface 335 located outside of the side portion of the swirler 310 surround the upper portion and the side portion.

When the swirler 310 rotates in one direction, the blades 317 and 318 of the swirler 310 transfer a portion of the contaminated air flowing toward the passage hole 319 of the rotating plate 311 to an outer side of the rotating plate 311 in a radial direction.

Here, the air pushed in the radial direction flows downward but must flow in a direction away from the center of the swirler 320 to form a vortex under the flow guide 330.

In order to induce such a flow of air, in this embodiment, the guide surface 335 is formed to extend obliquely downwards outward.

When the vortex forming device 300 is operated, the air pushed outward in the radial direction of the rotating plate 311 by the blades 317 and 318 of the swirler 310 flow to the guide surface 335 located outside the swirler 310 in the radial direction, and a flow direction of the air flowing toward the guide surface 335 is changed downward by the guide surface 335 formed to obliquely extended outwardly downward.

Here, if a boundary surface between the upper surface 331 and an inclined surface of the guide surface 335 are formed to be rounded, a loss of flow velocity of air flowing on the guide surface 335 may be reduced.

As described above, when the air pushed from the blades 317 and 318 of the swirler 310 flows along the guide surface 335, the air flows downward obliquely out of the lower portion of the flow guide 330.

In the process of sucking contaminated air through the inlet port 126, when the contaminated air passes through the inlet port 126, an upward flow of air is generated as not only the contaminated air but also the surrounding air passes through the inlet port 126.

A vortex may be formed under the swirler 310 as the upward flow of air and the flow of air generated by the rotation of the swirler 310 and flowing downwardly and obliquely.

Here, as the flow of the air generated by the rotation of the swirler 310 and flowing downwardly and obliquely increases, i.e., as the change in the flow direction to cause the flow direction of the air generated by the rotation of the swirler 310 is smoothly induced, the vortex is more effectively formed so that the vortex may be formed on a larger scale.

According to the present embodiment, the upper surface 331 of the flow guide 330 has an open region 331*a* that opens the upper portion of the swirler 310 and a closed region 331*b* that blocks the upper portion of the swirler 310.

The open region 331*a* is formed as the upper surface 331 of the flow guide 330 is penetrated in the up-down direction so that a passage through which external air is sucked into the main body part 100 through the inlet port 126 is opened.

In addition, the closed region 331*b* is formed as a horizontal plane that blocks the passage through which external air is sucked into the main body part 100 through the inlet port 126.

That is, in the horizontal plane formed by the upper surface 331 of the flow guide 330, a portion which is opened in the up-down direction becomes the open region 331*a* and a portion which is not opened but closed is the closed region 331*b*.

Here, the closed region 331*b* is located in front of the open region 331*a*. Specifically, the closed region 331*b* is located above a rotation region of the swirler 310 and is located at a position being biased forward at the rotation region of the swirler 310.

In this embodiment, it is illustrated that the upper surface 331 of the flow guide 330 is halved to the open region 331*a* located at a rear thereof and the closed region 331*b* located at a front thereof.

In addition, the closed region 331*b* is located above the rotation region of the swirler 310 and at least a portion thereof is located in front of the front surface 110*a* of the first casing 110. In addition, the open region 331*a* is located at the rear of the closed region 331*b* and at least a portion thereof is located at the rear of the front surface 110*a* of the first casing 110.

In this embodiment, it is illustrated that the closed region 331*b* is located in front of the front surface 110*a* of the first casing 110 and the open region 331*a* is located at the rear of the front surface 110*a* of the first casing 110.

If the entire upper surface 331 of the flow guide 330 includes only the open region 331*a*, the passage for the flow of air sucked into the main body part 100 through the inlet port 126 may be enlarged but adverse conditions are created for the formation of a vortex.

In order to effectively form the vortex, a downward air flow induced by the rotation of the swirler 310 must be strongly formed. However, when the entire upper surface 331 of the flow guide 330 includes only the open region 331*a* and the passage on the flow guide 330 is enlarged, the flow of the air sucked into the main body part 100 through the inlet port 126 from the outside of the local exhaust device 10, i.e., an upward flow of air passing through the inlet port 126 pass through most of the region occupied by the swirler 310. As described above, the upward flow of air passing through the swirler 310 weakens the intensity of the downward air flow induced by the rotation of the swirler 310, and thus, the downward flow induced by the rotation of the swirler 310 is weakened to cause a problem that a vortex is not properly formed.

However, if the entire upper surface 331 of the flow guide 330 is blocked, most of the passage for the flow of air sucked into the main body part 100 through the inlet port 126 is blocked, thereby preventing suction of contaminated air.

In consideration of this, the vortex forming device 300 of the present embodiment includes the flow guide 330 having the upper surface 331 halved into the open region 331*a* located at the rear and the closed region 331*b* located at the front.

According to this, through the open region 331*a* formed at the rear, a passage allowing the flow of air sucked into the main body part 100 through the inlet port 126 from the outside of the local exhaust device 10 to pass therethrough is provided.

Further, in the closed region 331*b* formed at the front, the upward air flow sucked into the main body part 100 from the outside of the local exhaust device 10 through the inlet port 126 cannot pass. In the closed region 331*b*, the upward flow of air is prevented from passing through the flow guide 330 to thereby increase the intensity of the downward air flow induced by the rotation of the swirler 310.

According to the present embodiment, the closed region 331*b* is located in front of the front surface 110*a* of the first casing 110, and the open region 331*a* is located at the rear of the front surface 110*a* of the first casing 110. The arrangement structure of the open region 331*a* and the closed region 331*b* is a result of design considering the shape of the flow path between the intake device 200 and the inlet port 126 for generating an intake air flow to induce an upward flow of air.

According to this, the open region 331*a* is located at the second extension line L2 connecting the intake device 200 accommodated in the first casing 110 and the inlet port 126, thereby forming a passage connecting the inlet port 126, the open region 331*a*, and the intake device 200 substantially in a straight line.

When the passage connecting the inlet port 126 and the intake device 200 in a straight line is formed as described above, the local exhaust device 10 may provide sufficient suction performance without being affected by the blockage of a portion of the flow guide 330.

In addition, the fact that the closed region 331*b* is located in front of the front surface 110*a* of the first casing 110 is significant in the following aspect.

First, since the closed region 331*b* is located in front of the front surface 110*a* of the first casing 110, the closed region 331*b* is located at a position outside the vicinity of the second extension line L2 connecting the intake device 200 and the inlet port 126.

That is, since the closed region 331*b* is located at a position away from the passage connecting the inlet port 126 and the intake device 200 in a straight line, a flow path may be designed such that the closed region 331*b* does not block the main passage through which the air introduced through the inlet port 126 flows to the intake device 200.

Accordingly, the local exhaust device 10 may provide sufficient suction performance without being affected by the blockage of a portion of the flow guide 330.

Second, since the closed region 331*b* is located at the front adjacent to the front surface 120*a* of the second casing 120, the vortex formed by the vortex forming device 300 may be formed to be larger at the front of the local exhaust device 10.

In general, it is difficult to properly suck contaminated air at a location far from the intake device 200 and the inlet port 126, particularly, at the front side of the local exhaust device 10.

A method for enhancing the suction performance for contaminated air located at the front of the local exhaust device 10 under a condition that does not increase the intake flow velocity of the intake device 200 may include a method of increasing a size of a vortex formed at the front of the local exhaust device 10.

In consideration of this, in this embodiment, the closed region 331*b* for increasing the intensity of the downward air flow induced by the rotation of the swirler 310 is located at the front adjacent to the front surface 120*a* of the second casing 120, whereby a vortex formed by the vortex forming device 300 is formed to be larger at the front of the local exhaust device 10, and accordingly, the suction performance for the contaminated air located on the front side of the local exhaust device 10 is effectively improved.

[Operation of Vortex Forming Device]

Figure 10:
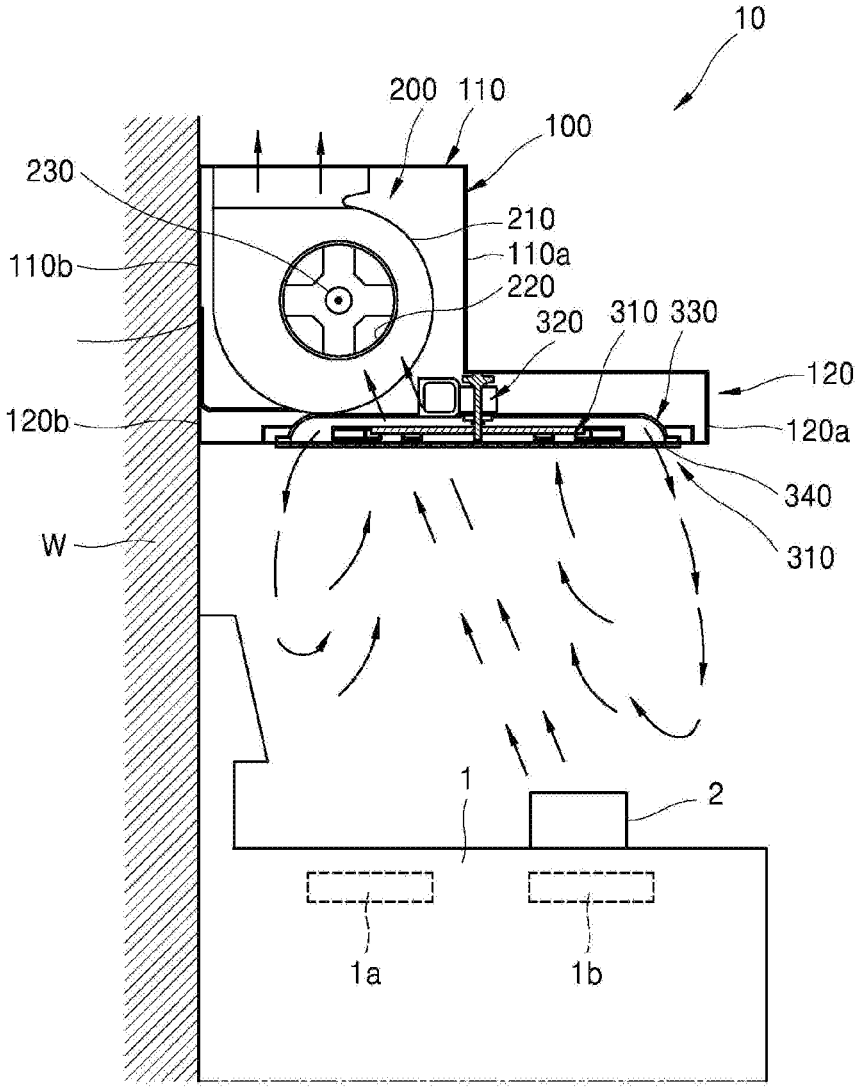
FIG. 10 is a view showing a flow of air generated when a local exhaust device according to an embodiment of the present invention operates.

FIG. 10 is a view showing a flow of air generated when a local exhaust device according to an embodiment of the present invention is operated.

Hereinafter, operations and effects of the local exhaust device and the vortex forming device provided therein will be described with reference to FIGS. 6, 9 and 10.

Referring to FIGS. 6, 9, and 10, when the operation of the local exhaust device 10 is started, the operation of the blowing device 200 starts, and accordingly, an intake air flow for sucking air outside the local exhaust device 100 toward the blowing device 200 installed in the main body part 100 is formed.

The intake air flow formed as described above acts on the external air to be sucked through the inlet port 126 formed at the lower portion of the main body part 100, and the external air around the inlet port 126 is sucked into the main body part 100 through the inlet port 126.

The air sucked into the main body part 100 and the contaminated air sucked together are sucked into the blowing device 200 through both sides of the blowing device 200 and then discharged to the outside through the discharge part 215 opened upward of the blowing device 200 and an external duct connected thereto.

Here, when the blowing device 200 is operated in the high air volume mode, an intake air flow at a high flow rate is formed to suck contaminated air from a longer distance, thereby increasing collection efficiency of the local exhaust device 10 for the contaminated air.

Meanwhile, when the blowing device 200 is operated in the low air volume mode, a speed of the intake air flow is lowered compared to the high air volume mode, so that the collection efficiency of the local exhaust device 10 for the contaminated air is lowered, but noise and power consumption that occur due to the driving of the blowing device 200 may be reduced.

According to this embodiment, when the blowing device 200 is operated in the low air volume mode, the operation of the vortex forming device 300 may be performed together. The vortex forming device 300 generates a vortex around the inlet port 126 to enlarge the suction region of the exhaust device, so that the contaminated air may be more efficiently sucked even when the speed of the intake air flow is low.

The operation of the vortex forming device 300 is that the swirler 310 rotated by power provided by the second driving unit 320 pushes air flowing toward the inlet port 126 to an outward direction of the swirler 310 and the air pushed out in this way forms a vortex shaped like a donut.

When the vortex is formed under the vortex forming device 300 by the operation of the vortex forming device 300, contaminated air rising from the lower side of the local exhaust device 10 may be smoothly sucked into the local exhaust device 10.

Meanwhile, the cooking appliance 1 may include a rear heating unit 1*a* and a front heating unit 1*b* spaced apart from each other in the front-rear direction.

In general, when the local exhaust device 10 is located above the cooking appliance 1 having the rear heating unit 1*a* and the front heating unit 1*b*, at least a portion of the rear heating unit 1*a* is located to overlap a local suction device 20 in the up-down direction.

Accordingly, the contaminated air generated when food 2 is heated using the rear heating unit 1*a* may be sucked into the local exhaust device 10 in a form of flowing substantially vertically upward along the intake air flow generated by a suction force of the intake device 200.

Meanwhile, as the first extension line L1 extending coaxially with the rotation center of the swirler 310 is located in front of the scroll housing 220, contaminated air generated in the process of heating the food 2 is affected by the suction force generated by the intake device 200 and the vortex formed by the vortex forming device 300 and flows obliquely toward the upper left of the drawing (FIG. 10).

That is, while contaminated air generated while heating the food 2 using the front heating unit 1*b* rises, the contaminated air may be prevented from flowing in a direction away from the wall W, and accordingly, it is possible to prevent contaminated air from spreading to the kitchen in which the cooking appliance 1 is installed.

In addition, since the main body part 100 is designed such that a distance D3 from the first extension line L1 to the rear surface 120*b* of the second casing 120 is longer than the distance D2 from the first extension line L1 to the front surface 120*a* of the second casing 120, a minimum distance between the inlet port 126 and the wall W may be sufficiently secured.

In this case, the air obliquely downwardly discharged from the vortex forming device 300 installed at the inlet port 126 may be prevented from flowing along the wall W. If a phenomenon in which air flows downward along the wall W occurs, the air flowing downward along the wall W may affect a flame generated in the cooking appliance 1 to degrade heating efficiency of the cooking appliance 1. However, this phenomenon may be prevented by the structure of the main body part 100 designed as described above.

Meanwhile, referring to the structure of the flow guide 330 provided in the vortex forming device 300 that serves to form a vortex, the upper surface 331 of the flow guide 330 is halved into the open region located at the rear and the closed region 331*b* located at the front, the closed region 331*b* is located in front of the front surface 110*a* of the first casing 110, and the open region 331*a* is located behind the front surface 110*a* of the first casing 110.

Since the open region 331*a* is located on the second extension line L2 connecting the intake device 200 accommodated in the first casing 110 and the inlet port 126 and the closed region 331*b* is located in front of the front surface 110*a* of the casing 110, a passage connecting the inlet port 126, the open region 331*a*, and the intake device 200 in a substantially straight line may be formed, and accordingly, the local exhaust device 10 may provide sufficient suction performance without being affected by a portion of the flow guide 330 being blocked.

In addition, since the closed region 331*b* is located in front of the front surface 110*a* of the first casing 110, that is, since the closed region 331*b* is located at the front adjacent to the front surface 120*a* of the second casing 120, the vortex formed by the vortex forming device 300 may be formed to be larger in front of the local exhaust device 10, whereby the suction performance of the local exhaust device 10 for contaminated air located at the front side may be effectively improved.

Although embodiments of the present disclosure have been disclosed for illustrative purposes, those skilled in the art will appreciate that various modifications, additions and substitutions are possible, without departing from the scope and spirit of the disclosure as disclosed in the accompanying claims. Therefore, the technical scope of the present disclosure should be defined by the technical spirit and scope of the accompanying claims.

What is claimed is:

1. A local exhaust device comprising:

a main body part having an inlet port formed on a lower surface thereof; and a vortex forming device installed on the main body part and configured to form a vortex so as to induce intake of external air through the inlet port, wherein the vortex forming device comprises:

a swirler disposed at the inlet port and rotated to form the vortex;

a driving part configured to rotate the swirler; and a flow guide disposed at the inlet port and configured to guide air flowing by a rotation of the swirler downward, wherein the flow guide comprises an upper surface disposed at an upper portion of the swirler, wherein the upper surface of the flow guide comprises an open region configured to open the upper portion of the swirler and a closed region configured to block the upper portion of the swirler, wherein the open region is formed by penetrating a portion of the upper surface of the flow guide so that a passage along which external air is suctioned into the main body part through the inlet port is opened and the upper surface of the flow guide is halved to the open region located at a rear thereof and the closed region located at a front thereof, and wherein the closed region is formed as a horizontal plane blocking the passage along which external air is suctioned into the main body part through the inlet port.

2. The local exhaust device of claim 1, wherein the closed region is located in front of the open region.

3. The local exhaust device of claim 1, wherein the closed region is disposed above a rotation region of the swirler and disposed at a position being biased forward at the rotation region of the swirler.

4. The local exhaust device of claim 1, wherein the main body part comprises:

a first casing accommodating an intake device configured to generate an intake force for intaking air; and a second casing provided below the first casing and having a horizontal sectional area larger than that of the first casing, the second casing having the inlet port provided on a lower surface thereof.

5. The local exhaust device of claim 4, wherein:

the first casing extends upward from an upper surface of the second casing, a rear surface of the first casing and a rear surface of the second casing are coplanar, the rear surface of the first casing and the rear surface of the second casing face a wall, and a front surface of the second casing is located in front of a front surface of the first casing.

6. The local exhaust device of claim 5, wherein a rotation center of the swirler is located frontward with respect to a vertical line passing through a rotation center of the intake device.

7. The local exhaust device of claim 6, wherein the closed region is formed as a horizontal plane blocking the passage along which external air is suctioned into the main body part through the inlet port and located in front of the open region.

8. The local exhaust device of claim 6, wherein the closed region is formed as a horizontal plane blocking the passage along which external air is suctioned into the main body part through the inlet port, and wherein the closed region is disposed above a rotation region of the swirler, and is disposed at a forwardly inclined position at the rotation region of the swirler.

9. The local exhaust device of claim 6, wherein the closed region is formed as a horizontal plane blocking the passage along which external air is suctioned into the main body part through the inlet port, and wherein the closed region is disposed above a rotation region of the swirler, and is located in front of a front surface of the first casing, and at least a portion of the open region is disposed at the rear with respect to the front surface of the first casing.

10. The local exhaust device of claim 1, wherein the flow guide further comprises a guide surface extending to be inclined outward and downward from an outer edge of the upper surface of the flow guide.

* * * * *